United States Patent [19]

Franke

[11] 4,315,155

[45] Feb. 9, 1982

[54] X-RAY DIAGNOSTIC GENERATOR WITH A MAS-RELAY

[75] Inventor: Kurt Franke, Erlangen, Fed. Rep. of Germany

[73] Assignee: Siemens Aktiengesellschaft, Berlin & Munich, Fed. Rep. of Germany

[21] Appl. No.: 85,699

[22] Filed: Oct. 17, 1979

[30] Foreign Application Priority Data

Nov. 14, 1978 [DE] Fed. Rep. of Germany ..... 2849427

[51] Int. Cl.[3] ..... H05G 1/34

[52] U.S. Cl. ..... 250/409; 250/413; 250/415

[58] Field of Search ..... 250/415, 409, 413

[56] References Cited

U.S. PATENT DOCUMENTS 2,583,095 1/1952 Goldfield et al. ..... 250/409

4,160,906 7/1979 Daniels et al. ..... 250/415

FOREIGN PATENT DOCUMENTS 2116705 10/1972 Fed. Rep. of Germany .

*Primary Examiner*—Alfred E. Smith
*Assistant Examiner*—T. N. Grisby
*Attorney, Agent, or Firm*—Hill, Van Santen, Steadman, Chiara & Simpson

[57] ABSTRACT

In an exemplary embodiment, an exposure time selector and a mAs relay are connected to a computer which controls the x-ray tube current according to the selected mAs product and the freely selected value of exposure time. For example, the exposure time may be set to any of a range of analog values for determining exposure time, while the mAs relay is disconnected from the exposure termination switching circuit.

2 Claims, 1 Drawing Figure

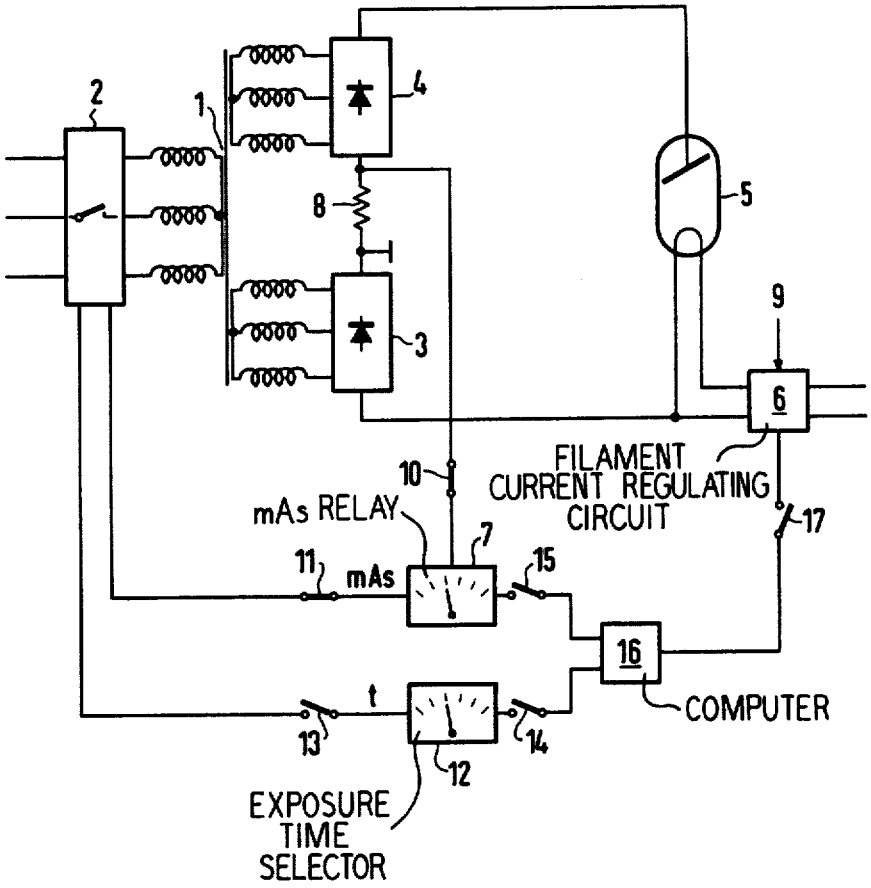
2
1
4
8
5
9
3
6
FILAMENT
CURRENT REGULATING
CIRCUIT
10
mAs RELAY
7
17
11
mAs
15
16
COMPUTER
t
13
14
12
EXPOSURE
TIME
SELECTOR

X-RAY DIAGNOSTIC GENERATOR WITH A MAS-RELAY

BACKGROUND OF THE INVENTION

The invention relates to an x-ray diagnostic generator for x-ray exposures with a mAs relay as well as with setting means for the exposure time which are connected together with the mAs relay to a computer which determines the x-ray tube current resulting from the values set and influences setting means for its setting.

In x-ray technology, there is often the desire in an x-ray diagnostic generator with mAs relay that, in addition to the data for the correct optical density of an x-ray exposure, i.e., in addition to the x-ray tube voltage and the mAs product, one also be able to set the exposure time. It is thereby possible to adapt the exposure time in an x-ray system for the production of series exposures to the bright sector time as well as to be able to optimally select it with respect to the movement blur or the preservation of the x-ray tube.

An x-ray diagnostic generator of the type initially cited is described in the German Offenlegungsschrift No. 21 16 705. In this x-ray diagnostic generator, the exposure time is input proceeding from an x-ray tomographic device for producing layer images. Only very specific, permanently predetermined values are selectable for the exposure time which depend on the movement path selected at the x-ray tomographic device. A free setting of the exposure time is not possible.

SUMMARY OF THE INVENTION

The object of the invention is to design an x-ray diagnostic generator of the type initially cited in such manner that the exposure time, given fixed values set for the x-ray tube voltage and the mAs product, can be freely varied and, thus, can be optimally adapted to the respective requirements.

This object is inventively achieved in that a selector for the free selection of the setting of the exposure time is present. This selector is interconnected via the computer with the mAs relay so that the computer can calculate and set the x-ray tube current resulting from the values set for the mAs product and the exposure time.

In the following, the invention is described in greater detail on the basis of the exemplary embodiment illustrated in the accompanying drawing; and other objects, features and advantages will be apparent from this detailed disclosure and from the appended claims.

BRIEF DESCRIPTION OF THE DRAWING

The single FIGURE is an electric circuit diagram illustrating an x-ray diagnostic generator in accordance with the present invention.

DETAILED DESCRIPTION

A three-phase x-ray diagnostic generator with a high voltage transformer 1 is illustrated in the drawing, whose primary winding can be connected via a switching device 2 to the mains network and whose secondary windings are connected to two high voltage rectifiers 3 and 4 connected in series with one another, which supply an x-ray tube 5. The x-ray current is set via the filament current by means of a regulating device 6.

For determining the optical density (or blackening) of an x-ray exposure, the x-ray tube voltage can be set in a manner not illustrated, for example, via a regulating transformer series connected to the input of the high voltage transformer 1 and the mAs product can be set via mAs relay 7. The mAs relay 7 measures the respective x-ray tube current via a precision resistor 8 in the x-ray tube current circuit and integrates this. Upon reaching the set mAs product, the mAs relay 7 actuates the switching device 2 to interrupt the x-ray exposure. During each exposure, the x-ray tube current is automatically set via a signal at input 9 in such manner that an overload of the x-ray tube 5 is prevented. In the manner of operating described, in which the user has no opportunity for determining the exposure time, the two switches 10 and 11 assume the closed positions indicated in the drawing.

An exposure time selector 12 is provided for the free setting of the exposure time and this time selector is connected into the circuit by means of switches 13 and 14 when the exposure time is to be freely set. Further, in this case, a switch 15 is closed, whereas the switches 10 and 11 are opened. In this case, a signal is supplied from the mAs relay 7 to a computer 16 which signal corresponds to the mAs product set, while the time selector 12 supplies a signal to the computer 16 which signal corresponds to the exposure time selected. The computer 16 calculates the x-ray tube current deriving therefrom the effects its setting via the setting device 6 (switch 17 being closed). In this case, the conventional control of the filament current regulating circuit 6 via input 9 is disabled, and an overload protection means is provided to insure that the x-ray tube 5 is not overloaded, i.e., that no currents can be set which are too high. The termination of an x-ray exposure in this case ensues after the expiration of the time set by means of the time switch 12 via the switching device 2. A switch 17 is only closed when one works with the time switch 12, so that the setting of the x-ray tube current ensues from the computer 16 only in this case.

It will be apparent that many modifications and variations may be effected without departing from the scope of the novel concepts and teachings of the present invention.

I claim as my invention:

1. An x-ray diagnostic generator for x-ray exposures comprising a mAs relay, exposure time selector means for selecting the exposure time, and a computer which determines the x-ray tube current, said exposure time selector means being operable to freely select any of a series of exposure time values given fixed values set for the x-ray tube voltage and the mAs product, means for connecting said exposure time selector and said mAs relay with said computer and providing for the control of x-ray tube current by said computer in accordance with the values of exposure time and mAs product selected at said exposure time selector means and at said mAs relay, and means for terminating an exposure in accordance with the value of exposure time selected at said exposure time selector means.

2. An x-ray diagnostic generator according to claim 1, with said mAs relay having means for sensing x-ray tube current during a relay operating mode and for interrupting an exposure upon reaching a selected mAs product value, said computer being operable in an x-ray tube current control mode for controlling x-ray tube current, and means (11, 13) for disabling said mAs relay from control of an exposure during said x-ray tube current control mode of operation of said computer.

* * * * *